United States Patent [19]

Meylan et al.

[11] 4,029,432

[45] June 14, 1977

[54] THERMAL TURBOMACHINE

[75] Inventors: Pierre Meylan, Neuenhof, Switzerland; Heinz Brunner, Waldshut, Germany

[73] Assignee: BBC Brown Boveri & Company Limited, Baden, Switzerland

[22] Filed: Nov. 11, 1975

[21] Appl. No.: 630,789

[30] Foreign Application Priority Data

Nov. 18, 1974 Switzerland ..... 15308/74

[52] U.S. Cl. ..... 415/101; 415/108

[51] Int. Cl.[2] ..... F01D 3/02

[58] Field of Search ..... 415/108, 100, 102, 103, 415/101, 219 R, 134, 135, 136

[56] References Cited

UNITED STATES PATENTS

| | | | |
|---|---|---|---|
| 1,014,659 | 1/1912 | Ljungstrom | 415/135 |
| 1,273,633 | 7/1918 | Ljungstrom | 415/135 |
| 1,625,541 | 4/1927 | Hodgkinson | 415/136 |
| 3,520,633 | 7/1970 | Mansson | 415/134 |
| 3,529,901 | 9/1970 | Hart et al. | 415/136 |
| 3,773,431 | 11/1973 | Bellati et al. | 415/135 |

FOREIGN PATENTS OR APPLICATIONS

| | | | |
|---|---|---|---|
| 874,251 | 6/1971 | Canada | 415/136 |

*Primary Examiner*—Henry F. Raduazo
*Attorney, Agent, or Firm*—Pierce, Scheffler & Parker

[57] ABSTRACT

A thermal turbomachine such as an axial flow steam turbine of the center intake opposite flow type includes an intake duct surrounding the rotor and which is delimited by a portion of the internal surface of an inner housing surrounding the rotor and by the juxtaposed surfaces of two rotationally symmetrical shells. In order to permit the shells to expand substantially unhindered in relation to the inner housing as a result of imposed thermal stresses and still provide a gastight seal between an internal surface portion of the inner housing and the peripheral portions of the shells the latter are pressed into a slidable sealing engagement with the former rather than rigidly attached to each other. According to one embodiment, the slidable sealing engagement between the parts is established by means of a groove provided on one part into which the other part is fitted. In another embodiment, the peripheral portions of the shell are pre-stressed so as to press against and slidably engage the internal surface of the inner shell.

10 Claims, 7 Drawing Figures

THERMAL TURBOMACHINE

The invention concerns a thermal turbomachine, especially a steam turbine, with an intake duct which is delimited by the internal surface of an inner housing and the opposed surfaces of two shell components. Steam turbines with inner housings of "single-shell" design have been known for some time, and are mainly used as low-pressure turbines. A turbine of such type is shown for example by the Swiss Pat. No. 416,677. Another similar turbine, which has been in use for a considerable time, is illustrated in FIG. 1 of this patent. The steamsupplying intake ducts of these turbines are delimited by the inner housing and two cone-shaped shell components. Each delimiting shell component also serves as a divider between the intake area and an adjacent bleeder area. The pressure and the temperature values are substantially greater in the intake area than in the bleeder areas, so that the arrangement of gastight seals between intake area and bleeder areas are a necessity. In the case of the known turbines this sealing was accomplished by rigid and gastight connections of the outer perimeters of the shell components with the internal surface of the inner housing. However, this design limits the magnitude of the utilizable pressures and temperatures because of the interaction between the shells and inner housing with respect to heat expansion, resulting in undesirable stresses and deformations within the shells and the inner housing.

The temperature existing within the intake area will cause the convex internal surface of the shell to expand in the direction of its generating lines and to bend, due to the different expansion of the concave exterior shell surface which is exposed to the lower temperature of the bleeder areas. The inner housing is likewise exposed to a variety of temperatures, depending on the various areas involved, undergoing corresponding deformations. Due to the rigid coupling between the shell and the inner housing, these components will interact in an undesirable manner. The steam pressure within the intake area which, as mentioned above, is greater than the steam pressure within the bleeder areas, and higher than the pressure beyond the inner housing, will likewise lead to stresses and deformations within the shells and the mantle of the inner housing, and amplified further in an undesirable manner by the rigid coupling of the parts involved. Obviously, the simultaneous influence by pressure and temperature will increase still further the stresses and deformations within the shells and the inner housing. This explains why only relatively low temperatures and pressures can be employed in the case of "single-shell" inner housing designs.

For higher operating temperatures and pressures, turbine manufacturers have for a long time used an inner housing of "multi-shell" design, as illustrated and described for example in Swiss Pat. No. 426,888. This type of construction does avoid the above described disadvantages incurred by a "single-shell" inner housing, but constructions of this type are complicated and costly.

It is the primary object of the invention to eliminate the above discussed disadvantages of the known thermal turbomachines, and to design such turbomachine with a single-shell inner housing where the stresses and deformations, which will occur due to operating temperatures and pressures within the inner housing and the shell parts bordering the intake area, are reduced to such degree that the turbomachine can be run under substantially greater operating temperatures and pressures than has been feasible heretofore and without impairing the safety of operations.

This problem is solved by the invention in that manner that there are provided between the inner housing and each shell part means to insure a gastight seal during operations between a rigid portion of the inner housing and the shell, as well as means to make feasible a substantially unobstructed heat expansion by the shell and to avoid any interaction between shell and inner housing relative to thermal stresses and thermal deformations.

Practical examples of the invention will be explained below on the basis of the accompanying drawings wherein.

Figure 6:
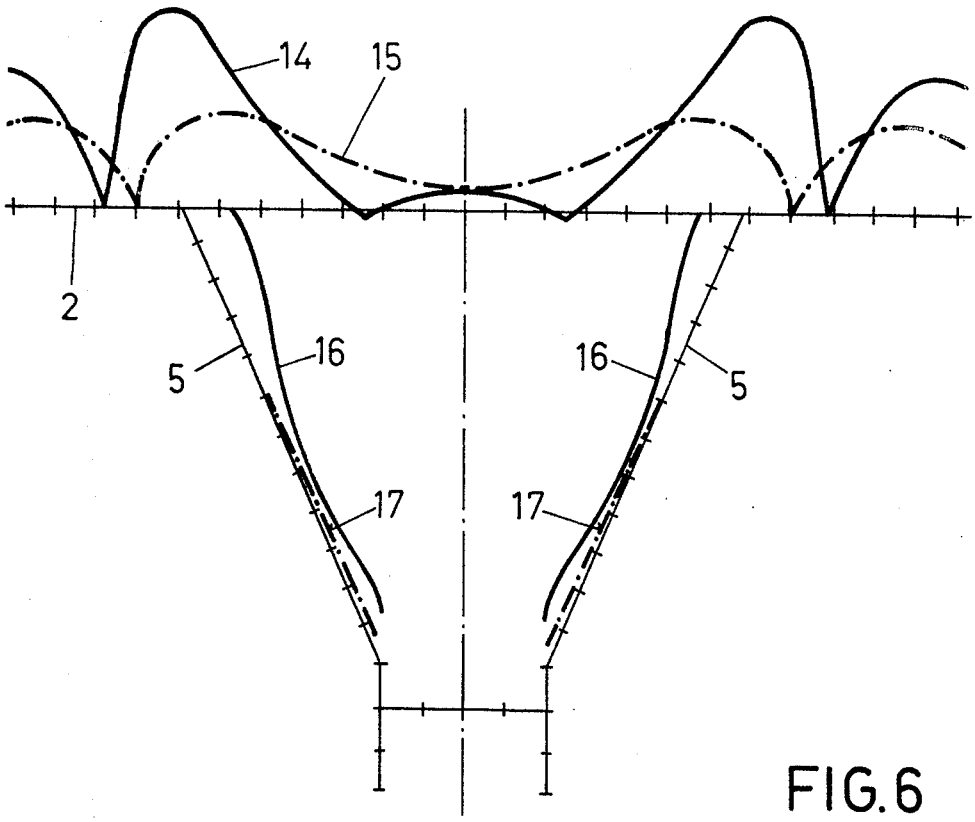
Figure 7:
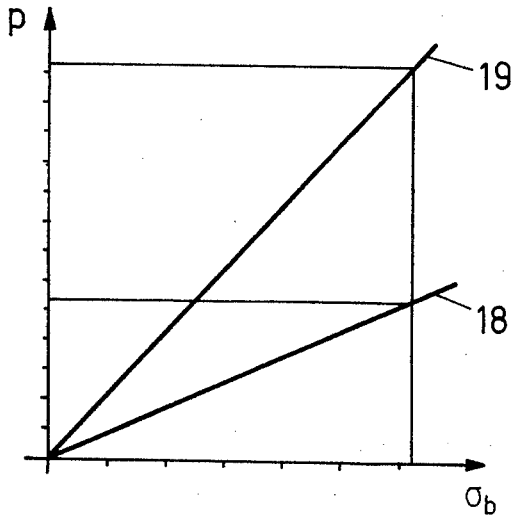

FIG. 6 shows the course of the curves for the meridian bending stresses which occur within the inner housing and the shells as a result of the wall temperatures and the temperature drop across the wall thicknesses, in the case of the known design of rigid construction as well as in the case of thermal expansivity, the design proposed by the invention; and FIG. 7 shows in the form of a graph the permissible pressure within the intake area in functional relation to that meridian bending stress which remains for utilization if the meridian bending stress caused by the temperature is deducted from the maximum allowable bending stress within the inner housing wall.

In the various figures identical components are denoted by identical reference numerals.

Figure 1:
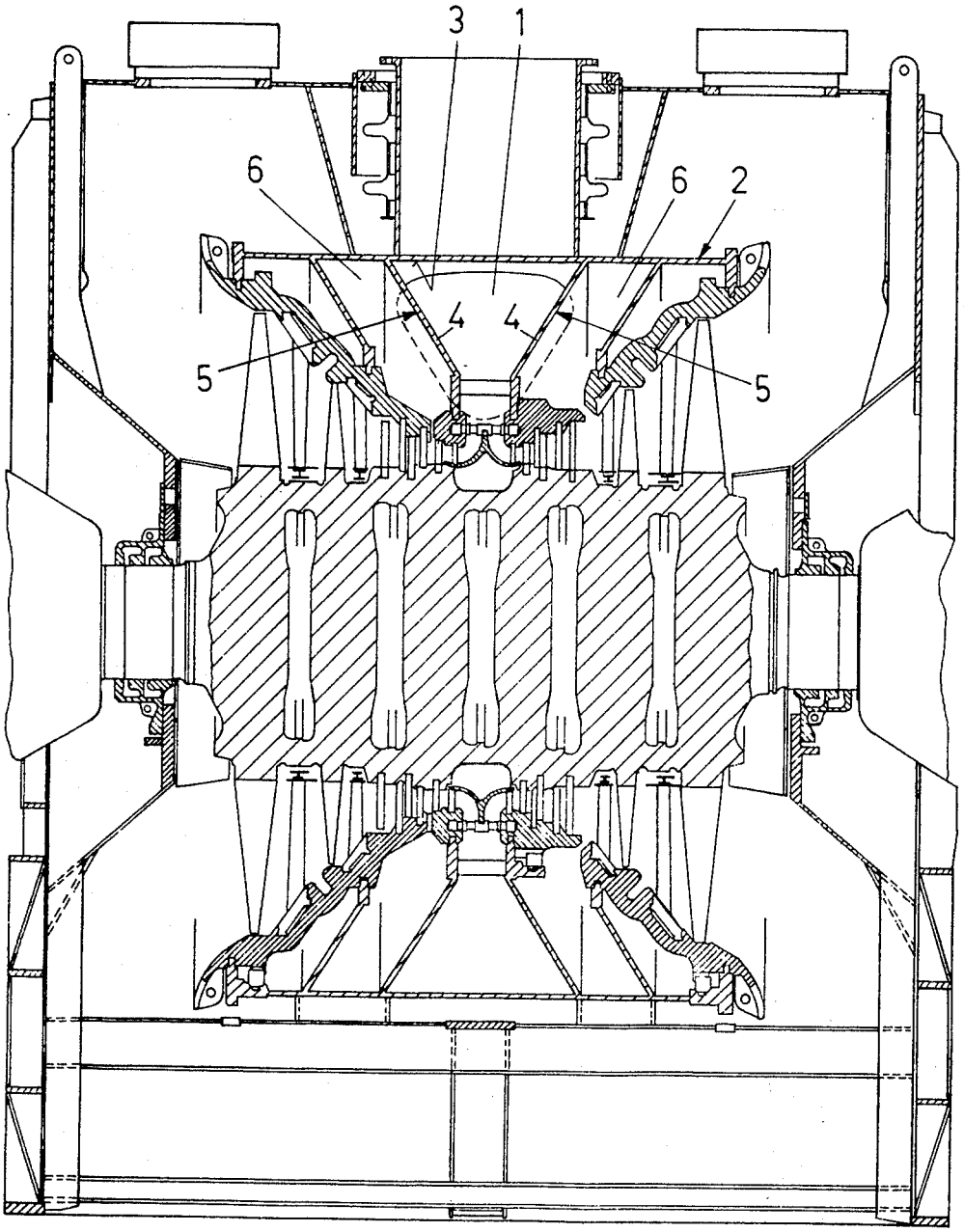
FIG. 1 depicts a known steam turbine with an inner housing of "single-shell" construction where each of the two shell parts bordering the intake duct are fastened rigidly with their perimeters to the internal wall of the inner housing.

The known turbine of the center inlet opposite flow type, shown by FIG. 1 in schematic form, has a center intake duct 1 for the supply of steam, which is bounded by the internal surface 3 of the inner housing 2 and the opposed surfaces 4 of two rotationally symmetrical cone-shaped shell parts 5. The outer perimeter of each shell 5 is rigidly and gastightly connected to the internal surface 3 of the inner housing 2, thus insuring a gastight separation of the intake duct 1 from the adjacent bleeder area 6. The rigid coupling of the shells 5 with the inner housing 2 leads to the above discussed disadvantageous interaction between shells 5 and inner housing 2 concerning thermal stresses and deformations.

In FIGS. 2, 3, 4 and 5, this connection between shells 5 and the inner housing 2, which border the intake area 1, is no longer rigid but makes now possible an unhindered heat expansion of the shells 5 relative to the inner housing 2, or respectively to the ring 7, rigidly connected to the latter, while there is still being maintained, at least during operations, a gastight seal between shells 5 and the ring 7. The means which will insure this seal comprise a first sealing surface 8, arranged at ring 7, and a second sealing surface 9 on shell 5 which is opposed to the first surface and which can be pressed elastically against it. The operation pressure acting upon the shell 5 will press the second sealing surface 9 in the direction of the first sealing surface 8, thus insuring a gastight seal between the sealing surfaces 8 and 9.

It is also possible to arrange the shells 5 relative to the rigid ring 7 in such manner that they will be in a prestressed state when in contacting position caused by an elastic deformation thusly that the second sealing surface 9 on shell 5 will exert a compressive force onto the first sealing surface 8 on ring 7 even if operations are at a standstill. This prestressed state of the shells 5 can be attained by a suitable selection of the ratio of the distances between the first and the second sealing surfaces, or by means of a number of other appropriate methods.

Figure 2:
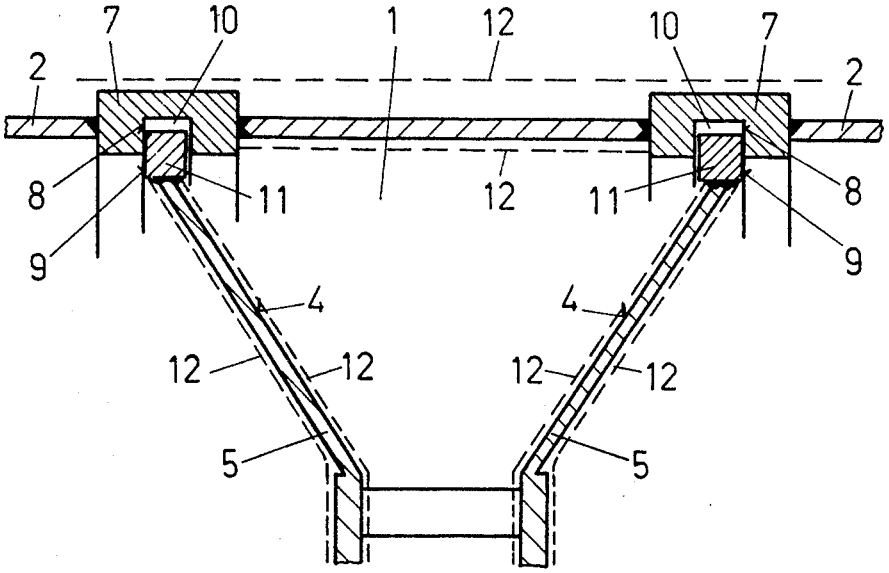
FIG. 2 shows one portion of the turbine which is designed in accordance with the invention where the shell parts are separated from the inner housing, and where the thermal expansion of each shell part — while maintaining gastight contact with the inner housing — takes place almost unopposed within an annular groove of a rigid ring which is arranged coaxially to the inner housing.
Figure 3:
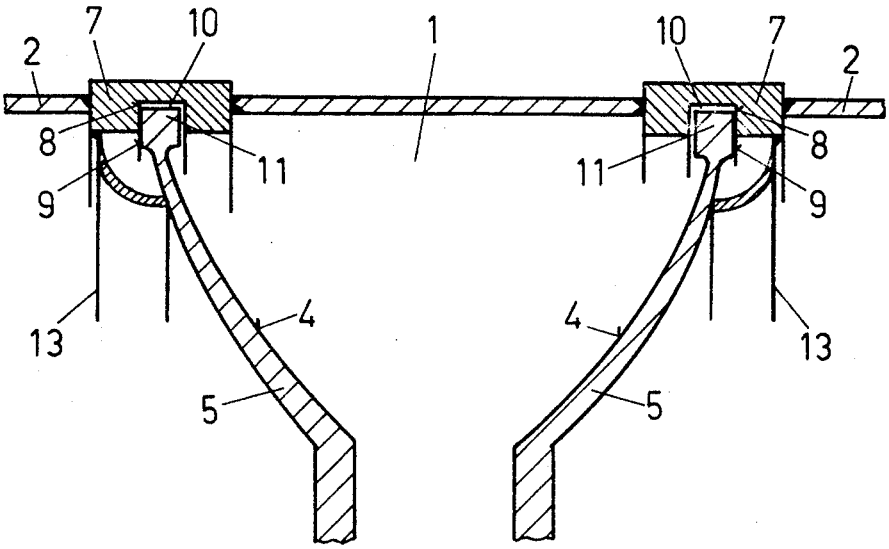
FIG. 3 depicts a species similar to the design shown by FIG. 2 where the shell parts posses a special curved section of variable thickness, made for example from cast steel, and are equipped with additional elastic sealing shells.

In the case of the species shown by FIGS. 2 and 3, the rigid ring 7, which is arranged coaxially to the inner housing 2, is provided at its internal surface with an annular groove 10, with one of its sides forming a plane first sealing surface 8. This surface is faced by the second sealing surface 9, located on the shell 5 and formed at the outer side of the flange-like thickening 11 at the periphery which protrudes into the annular groove 10. The dimensions of the annular groove 10 are selected in such manner that even the maximum thermal expansion of the shell 5 in radial direction can take place without hindrance. The shell 5 shown by FIG. 2 is constructed by means of welding, while the shell shown by FIG. 3 possesses a special arcuate section of variable thickness which decreases in the direction of its periphery and made, for example, from cast steel. FIG. 2 further shows shielding 12 provided on both sides of the two shells 5 and on both sides of the inner housing 2. Such shielding 12 can be fastened heat-yieldingly to one or both sides of the shell 5 and/or of the inner housing surface in order to reduce the temperature drop across the thickness of the shell 5 or inner housing 2 respectively, thereby lowering the stresses caused by this difference in temperature.

FIG. 3 shows an elastic, thin sealing shell 13 for each shell 5 which spans the area of contact and which is connected gastightly, for example by welding, to the ring 7 as well as to the shell 5. This sealing shell 13 is an additional safety device to insure a proper seal between shells 5 and inner housing 2.

Figure 4:
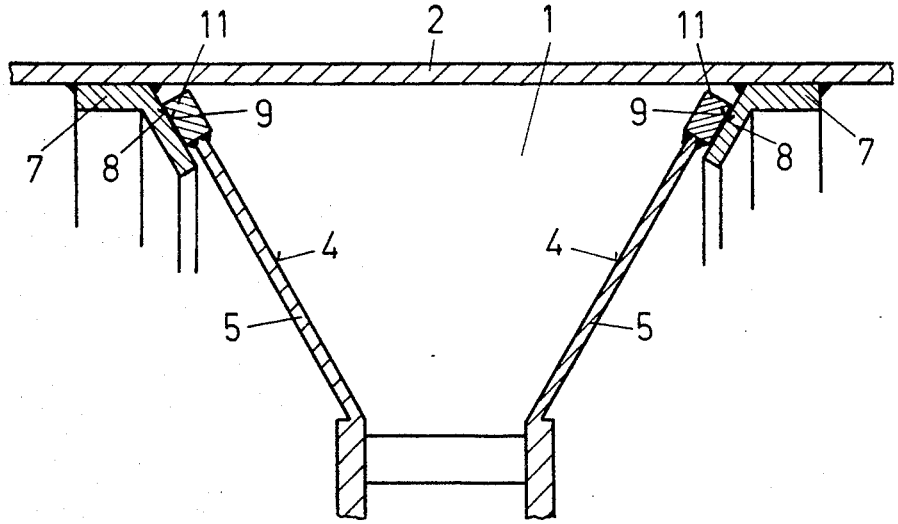
FIG. 4 depicts another species similar to the design shown by FIG. 2 where the gastight seal between one shell part and the inner housing is formed by the contact of a conical convex sealing area of the rigid ring with a conical concave sealing area of the shell part.
Figure 5:
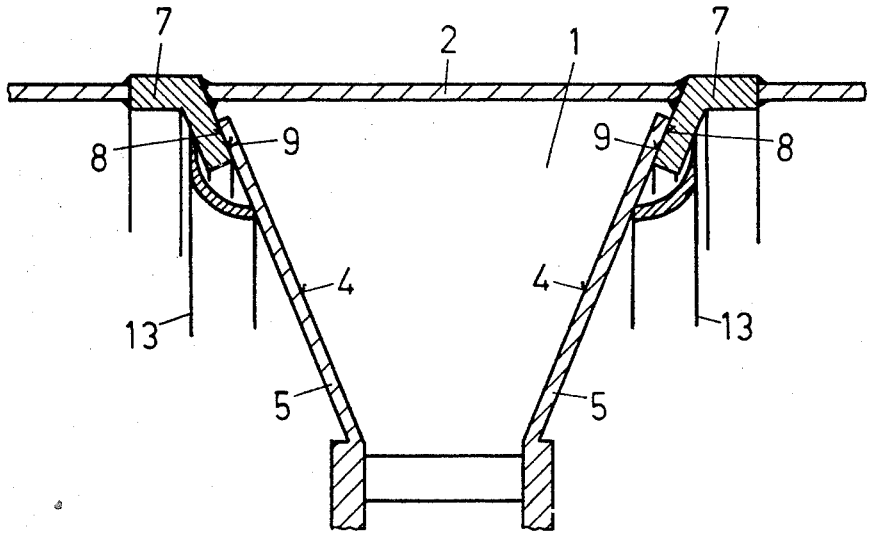
FIG. 5 depicts a modification of the species shown by FIG. 4 where additional elastic sealing shells are provided.

In the case of the species shown by FIG. 4 and 5, ring 7 is provided with a conical surface serving as the first sealing surface 8 which interacts with a conical surface which is formed at the periphery of shell 5 and which serves as the second sealing surface 9. The slopes of the two conical surfaces, measured relative to the turbine axis, are made approximately equal in order to attain a good seal. The ring 7 extends, in the case of both figures, coaxially to the inner housing 2, but is either fastened at the interior of the inner housing (FIG. 4), or welded between two sections of the inner housing surface (FIG. 5). The shells 5 shown by FIG. 4 possess flange-like thickenings 11. FIG. 5 shows the sealing shells 13 which are provided to make the seal still more secure.

Among the stresses which are generated within the inner housing 2 and within the shells 5 by the operating pressure and temperature, those meridian bending stresses that are caused as a result of the wall temperatures and the temperature drop across the wall thicknesses in the inner housing 2 and the shells 5, have the greatest magnitudes and will do the greatest damage. The character of these stresses which are caused by temperature alone and which occur at the inner housing 2 and the shells 5, is demonstrated by the curves 14 and 16 for the known, rigid construction, and by curves 15 and 17 for the heat-movable construction proposed by the invention (see FIG. 6). Identical temperature conditions were used for the two different cases. The curves 14 and 15 show conditions of the inner housing 2, and curves 16 and 17 are concerned with the shells 5. These curves show clearly that the greatest meridian bending stresses, caused by the temperatures alone, will occur within the inner housing 2, and that the maximum value of these stresses in the case of the known construction is approximately two-fold in magnitude in comparison with the corresponding maximum value in the case of the construction proposed by the invention. It becomes therefore possible to increase the pressure or the temperature, or the pressure as well as the temperature very substantially in the case of the construction proposed by the invention. This is further demonstrated by FIG. 7 where curve 18 relates to the known construction and curve 19 to the construction according to the invention. As mentioned above, these two curves 18 and 19 represent the permissible pressure P within the intake area as a function of the meridian bending stress $\sigma_b$, which is still available if the meridian bending stress, caused by the temperature alone, is deducted from the total, maximum permissible bending stress within the inner housing wall. The construction proposed by the invention will make it possible, in the case of a standing meridian stress, to allot a pressure P still available which has approximately 2.5 times the magnitude of the pressure which can be employed in the case of the known construction. Obviously, it is also feasible to increase the temperature instead of the pressure, or the pressure as well as the temperature, provided that the total maximum allowable meridian bending stress is not exceeded. This possibility of a significant increase in operating pressures and/or temperatures is to be considered a surprising result which is attained by the construction proposed by the invention, effecting at slight additional costs a substantially better and more efficient use of the turbine.

Naturally, the species illustrated can be modified further. For example, the shell 5, shown by FIGS. 2 and 3, could be provided at its perimeter with a ring, with an annular groove arranged at the outer side of the ring, and the inner housing could be provided with an inwardly directed annular projection, protruding into the annular groove of the ring attached to the shell. Also, shielding 12 and sealing shells 13 can be provided and used for their specific purposes for all species described above.

The central intake of a turbine constructed in accordance with the invention has the following significant advantages:

a. The expansions of the shells caused by heat and pressure will not be hindered by the inner housing and, vice versa, the heat and pressure expansions of the inner housing are not hindered by the shells;

b. the pressure and temperature stresses arise within the inner housing and within the shells without influencing each other, and their values will be substantially lower in magnitude as a result thereof. Especially the critical maximum meridian bending stress, which occurs due to the wall temperatures and the temperature drop across the thickness of the inner housing wall, will have a substantially lower value than in the case of the known construction;

c. the factors of operation, such as pressure and temperature, and correspondingly the achievable output, can be increased substantially without impairing the safety of operations;

d. the "single-shell" design which is relatively simple, inexpensive and reliable in operation and which can be built without difficulties, readily replaces the complicated and costly "multi-shell" design which under the present state of art is being used for high pressures and temperatures.

We claim:

1. In a thermal turbomachine, such as a steam turbine, and which is provided with an intake duct that is delimited by the internal surface of an essentially rigid part of an inner housing surrounding the rotor and by the opposed surfaces of two rotationally symmetrical shells, the improvement wherein there are provided means to ensure a gastight seal during operations between said rigid part of said inner housing and each said shell and which comprise means providing axially spaced first sealing surfaces fixed to said rigid part of said inner housing, and means providing second sealing surfaces respectively on the peripheral portions of said shells, said first and second sealing surfaces being pressed against each other by the operating pressure of the fluid operating medium admitted to said turbomachine thereby to effect said gastight seal, and said first and second sealing surfaces having cooperating means capable of relative movement with respect one another and allowing a substantially unobstructed heat expansion by each said shell thereby to avoid any interaction between said shells and said inner housing related to thermal stresses and thermal deformation.

2. Turbomachine as defined in claim 1 wherein said first and second sealing surfaces have a conical configuration.

3. Turbomachine as defined in claim 1 wherein said shells in the position of contact, are in a prestressed state caused by elastic deformation such that said second sealing surface will exert a compressive force onto said first sealing surface even if operations are at a standstill.

4. Turbomachine as defined in claim 1, wherein said rigid part of said inner housing for each shell is a ring arranged coaxially to said inner housing.

5. Turbomachine as defined in claim 4, wherein each said ring is provided at its internal surface with an annular groove and one side of the groove serves as said first sealing surface.

6. Turbomachine as defined in claim 5, wherein the width and depth of the annular groove in said ring are dimensioned such that the maximum heat expansion by said shell occurring in a radial direction, takes place substantially unhindered.

7. Turbomachine as defined in claim 5, wherein the outer contours of said shell protrude into said annular groove, and wherein said shell has a flat surface which is designed as said second sealing surface.

8. Turbomachine as defined in claim 1, wherein a shielding is fastened heat-yieldingly to at least one side of said inner housing and to at least one side of said shell which lowers the temperature drop across the thickness of said inner housing and said shell respectively, and reduces the stresses caused by this difference in temperature.

9. Turbomachine as defined in claim 1, wherein there is provided as an additional sealing means an elastic, thin sealing shell which spans the area of contact between said sealing surfaces and which is gastightly connected to said inner housing as well as to said shell.

10. Turbomachine as defined in claim 2, wherein a flange-like thickening is provided at the periphery of each shell with said second sealing surface formed on one of its sides.

* * * * *